US006848460B2

(12) United States Patent
Zheng

(10) Patent No.: US 6,848,460 B2
(45) Date of Patent: Feb. 1, 2005

(54) COLLAPSIBLE SLEEPING STRUCTURES

(75) Inventor: Yu Zheng, Walnut, CA (US)

(73) Assignee: Patent Category Corp., Walnut, CA (US)

( * ) Notice: Subject to any disclaimer, the term of this patent is extended or adjusted under 35 U.S.C. 154(b) by 0 days.

(21) Appl. No.: 10/092,844

(22) Filed: Mar. 6, 2002

(65) Prior Publication Data

US 2003/0168093 A1 Sep. 11, 2003

(51) Int. Cl.[7] ..... E04H 15/40
(52) U.S. Cl. ..... 135/126; 135/137
(58) Field of Search ..... 135/125, 126, 135/128, 137, 143, 115, 117

(56) References Cited

U.S. PATENT DOCUMENTS

| | | | | |
|---|---|---|---|---|
| 2,266,853 A | * | 12/1941 | Dabney | 135/126 |
| 2,290,786 A | * | 7/1942 | Varady | 5/418 |
| 3,847,170 A | * | 11/1974 | Anderson | 135/95 |
| 4,825,892 A | | 5/1989 | Norman | |
| 5,137,044 A | | 8/1992 | Brady | |
| 5,195,551 A | | 3/1993 | Ju | |
| 5,301,705 A | | 4/1994 | Zheng | |
| 5,370,145 A | | 12/1994 | Wu | |
| 5,467,794 A | | 11/1995 | Zheng | |
| 5,560,385 A | | 10/1996 | Zheng | |
| 5,562,115 A | | 10/1996 | Sotelo | |
| 5,582,197 A | | 12/1996 | Dobberstein | |
| 5,645,096 A | | 7/1997 | Hazinski et al. | |
| 5,699,820 A | | 12/1997 | Evans et al. | |
| 5,778,915 A | | 7/1998 | Zheng | |
| 5,975,101 A | | 11/1999 | Zheng | |
| 6,073,283 A | * | 6/2000 | Zheng | 5/417 |
| 6,098,349 A | | 8/2000 | Zheng | |
| 6,109,281 A | * | 8/2000 | Lowenthal | 135/125 |
| 6,138,701 A | | 10/2000 | Zheng | |
| 6,170,100 B1 | * | 1/2001 | Le Gette et al. | 5/417 |
| 6,289,910 B1 | | 9/2001 | Zheng | |
| 6,328,050 B1 | | 12/2001 | McConnell | |
| 6,604,537 B2 | * | 8/2003 | Zheng | 135/126 |
| 2001/0034274 A1 | * | 10/2001 | Tulipani et al. | 473/446 |

FOREIGN PATENT DOCUMENTS

| | | |
|---|---|---|
| EP | 0 331 029 | 2/1989 |
| EP | 1 054 121 | 10/2000 |
| EP | 1 069 263 | 1/2001 |
| WO | WO 91/02870 | 3/1991 |

* cited by examiner

*Primary Examiner*—Janet M. Wilkens
(74) *Attorney, Agent, or Firm*—Raymond Sun

(57) ABSTRACT

A collapsible structure having at least one foldable frame member having a folded and an unfolded orientation, with a fabric material covering portions of the frame member to form at least one panel when the frame member is in the unfolded orientation, and a mat coupled adjacent the bottom side of at least one of the at least one panel.

18 Claims, 13 Drawing Sheets

COLLAPSIBLE SLEEPING STRUCTURES

BACKGROUND OF THE INVENTION

1. Field of the Invention

The present invention relates to collapsible structures, and in particular, to collapsible structures that incorporate a sleeping accessory.

2. Description of the Prior Art

There are presently many collapsible structures that are being provided for use by children and adults. Examples of these collapsible structures are illustrated in the following patents: U.S. Pat. No. 5,816,954 (Zheng), U.S. Pat. No. 6,006,772 (Zheng), U.S. Pat. No. 5,778,915 (Zheng), U.S. Pat. No. 5,467,794 (Zheng), U.S. Pat. No. 5,975,101 (Zheng), U.S. Pat. No. 5,722,446 (Zheng), U.S. Pat. No. 4,858,634 (McLeese), U.S. Pat. No. 4,825,592 (Norman), U.S. Pat. No. 5,964,533 (Ziglar), U.S. Pat. No. 5,971,188 (Kellogg et al.), and U.S. Pat. No. 5,038,812 (Norman), among others. These collapsible structures are supported by one or more frame members that can be twisted and folded to reduce the overall size of the structure. These collapsible structures can be used in a wide variety of applications, such as containers, tents, play structures, executive toys, shelters, sports structures, and others. As a result, collapsible structures have become very popular.

One other possible application for such collapsible structures is for use as a slumber tent, where a sleeping accessory or equipment, such as a sleeping bag, pillow, light futon or mattress, or similar support, is incorporated with the collapsible structure. When a collapsible structure is being adapted for use as a sleeping or slumber tent, ease of use (i.e., convenience) and storage considerations become important. For example, such a structure should provide quick and convenient access to the interior, and should be easy to fold into a smaller configuration for storage.

Thus, there still remains a need to provide collapsible sleeping structures that are convenient to use and that are easy to store.

SUMMARY OF THE DISCLOSURE

It is an object of the present invention to provide a collapsible structure that incorporates a sleeping implement.

It is another object of the present invention to provide a collapsible sleeping structure that are convenient to use and to store.

In order to accomplish the objects of the present invention, the present invention provides a collapsible structure having at least one foldable frame member having a folded and an unfolded orientation, with a fabric material covering portions of the frame member to form at least one panel when the frame member is in the unfolded orientation, and a mat coupled adjacent the bottom side of at least one of the at least one panel.

According to one embodiment of the present invention, the structure has a first panel, a second panel and a third panel, each panel having a foldable frame member that has a folded and an unfolded orientation. The left side of the first panel is hingedly coupled to the right side of the second panel, the right side of the first panel is hingedly coupled to the left side of the third panel, and the left side of the second panel and the right side of the third panel are free of any connections to any panels.

According to another embodiment of the present invention, the structure has two frame members, each frame member having a first end and a second end that are adapted to contact a surface, with the two frame members overlapping each other.

According to yet another embodiment of the present invention, the structure has a plurality of separate panels that are hingedly coupled to each other.

According to yet another embodiment of the present invention, the at least one frame member is a frame member having a figure-eight configuration when in the unfolded orientation, the figure-eight configuration defining a first loop, a second loop, and a crossover that forms the apex of the frame member in the unfolded orientation and with the first and second loops extending downwardly from the apex.

BRIEF DESCRIPTION OF THE DRAWINGS

FIGS. 4–7A are perspective views of collapsible structures according to different embodiments of the present invention.

DETAILED DESCRIPTION OF THE PREFERRED EMBODIMENTS

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

The present invention provides collapsible structures that incorporate a sleeping implement, such as a sleeping bag, pillow, light futon or mattress, or similar support. As used herein, the terms "hingedly coupled" or "hingedly connected" shall mean to couple two edges or sides by stitching, or by the use of removable attachment mechanisms (such as VELCRO™ pads or opposing toggles and loops, among others).

Figure 1A:
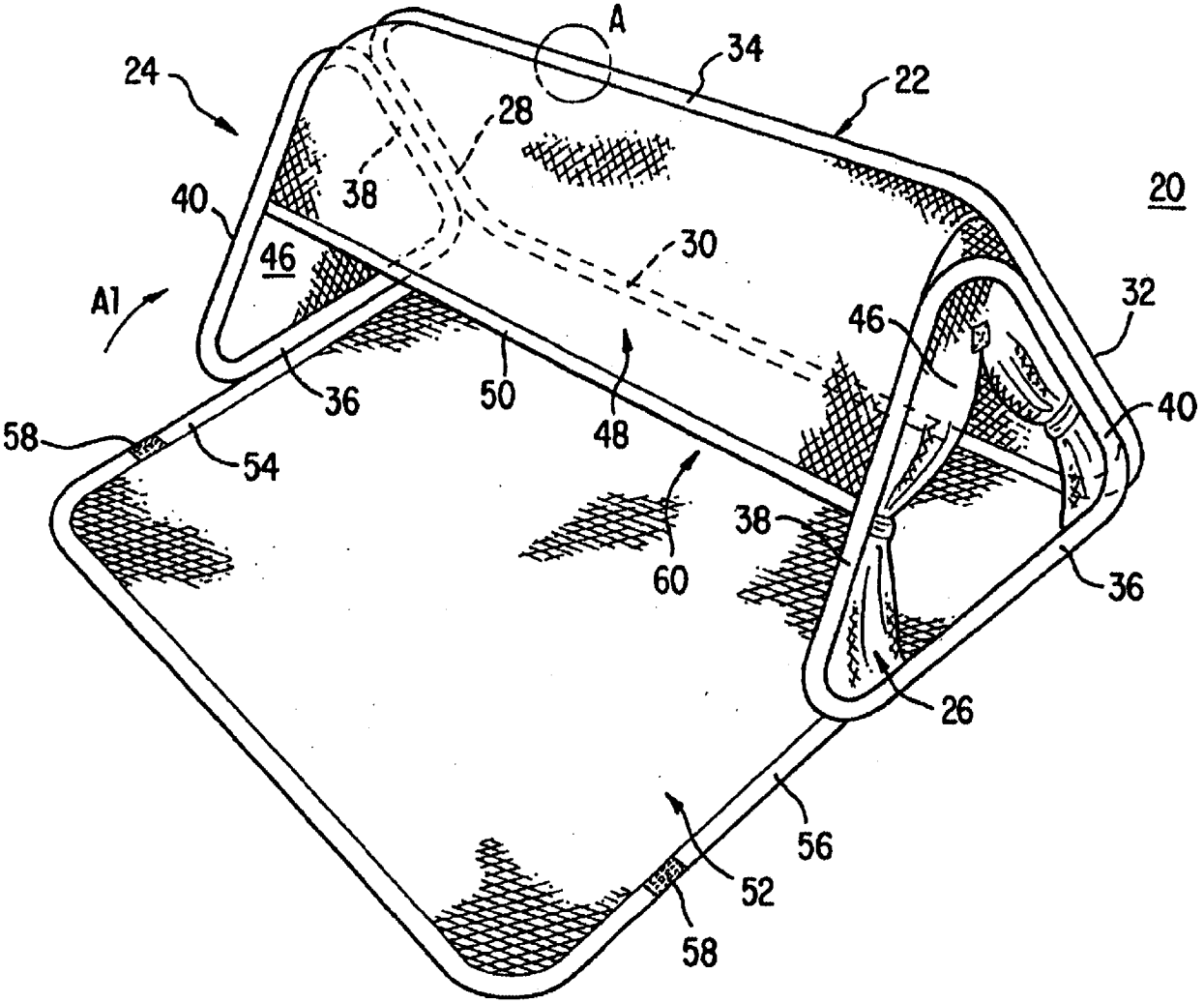
FIG. 1A is a perspective view of a collapsible structure according to one embodiment of the present invention.
Figure 1B:
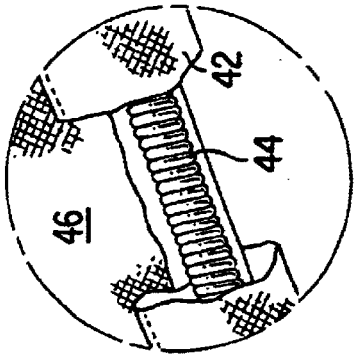
FIG. 1B is a partial cut-away view of the section A of the structure of FIG. 1A illustrating a frame member retained within a sleeve.

FIG. 1A illustrates a collapsible structure 20 that has three panels 22, 24 and 26 that are connected to each other to partially enclose a space. One panel 22 acts as a central panel, and the other two panels 24 and 26 are side panels. The panel 22 has four sides, with a left side 28, a bottom side 30, a right side 32 and a top side 34. Each of the side panels 24 and 26 has a three-sided configuration, with a bottom side 36, a left angled side 38, and a right angled side 40. The right side 40 of the panel 26 is hingedly conected to the right side 32 of the panel 22, and the left side 38 of the panel 24 is hingedly conected to the left side 28 of the panel 22. Each panel 22, 24 and 26 has a continuous frame retaining sleeve (e.g., see 42 in FIG. 1B) provided along and traversing the edges of its sides. A continuous frame member 44 is retained or held within each frame retaining sleeve 42 to support and define the shape of each panel 22, 24 and 26. Only one frame member 44 is shown in FIG. 1B; the other frame members are not shown but are the same as frame member 44.

Figure 3A:
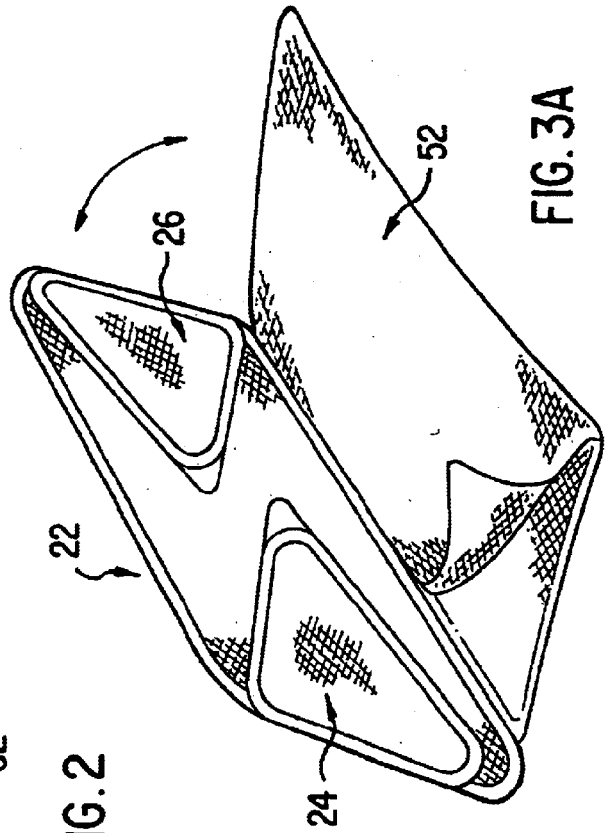
FIGS. 3A–3E illustrate how the structure of FIGS. 1A and 2 can be twisted and folded to reduce the structure to a size which is a fraction of the size of the free-standing structure.
Figure 3B:
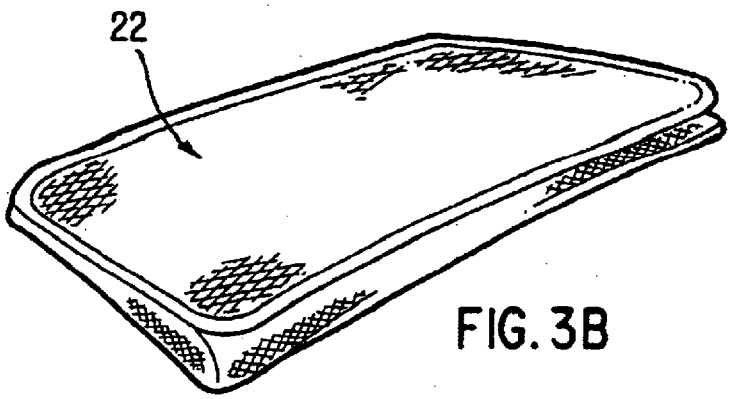
Figure 3C:
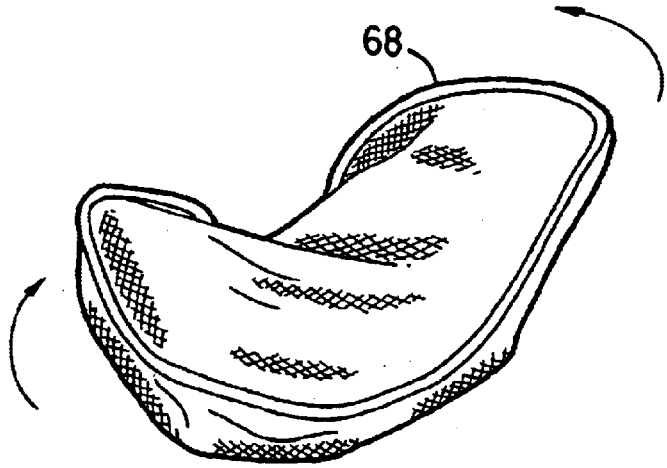
Figure 3D:
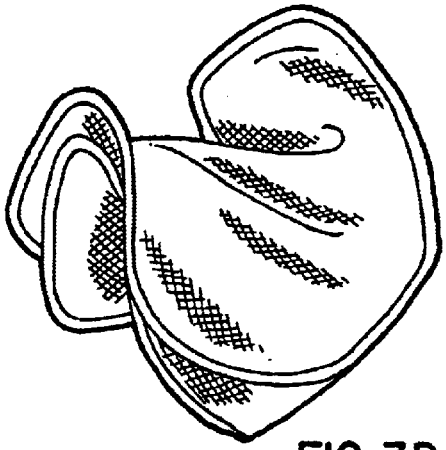
Figure 3E:
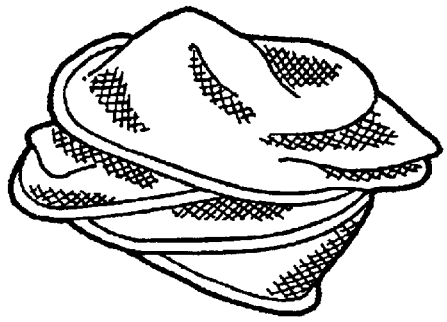

The continuous frame members 44 may be provided as one continuous loop, or may comprise a strip of material connected at both ends to form a continuous loop. The continuous frame members 44 are preferably formed of flexible coilable steel, although other materials such as plastics may also be used. The frame members 44 should be made of a material which is relatively strong and yet is flexible to a sufficient degree to allow it to be coiled. The material should have a memory that allows the frame members to spring back to the expanded position when unfolded from the folded position. Thus, each frame member 44 is capable of assuming two positions or orientations, an open or expanded position such as shown in FIG. 1A, or a folded position in which the frame member is collapsed into a size which is much smaller than its open position such as shown in FIG. 3E.

Fabric or sheet material 46 extends across each panel 22, 24, 26, and is held generally taut by the respective frame members 44 when in its open position. The term fabric is to be given its broadest meaning and should be made from strong, lightweight materials and may include woven fabrics, sheet fabrics or even films. The fabric should be water-resistant and durable to withstand the wear and tear associated with rough treatment by children. The frame members 44 may be merely retained within the respective frame retaining sleeves 42 without being connected thereto. Alternatively, the frame retaining sleeves 42 may be mechanically fastened, stitched, fused, or glued to the frame members 44 to retain them in position.

Figure 2:
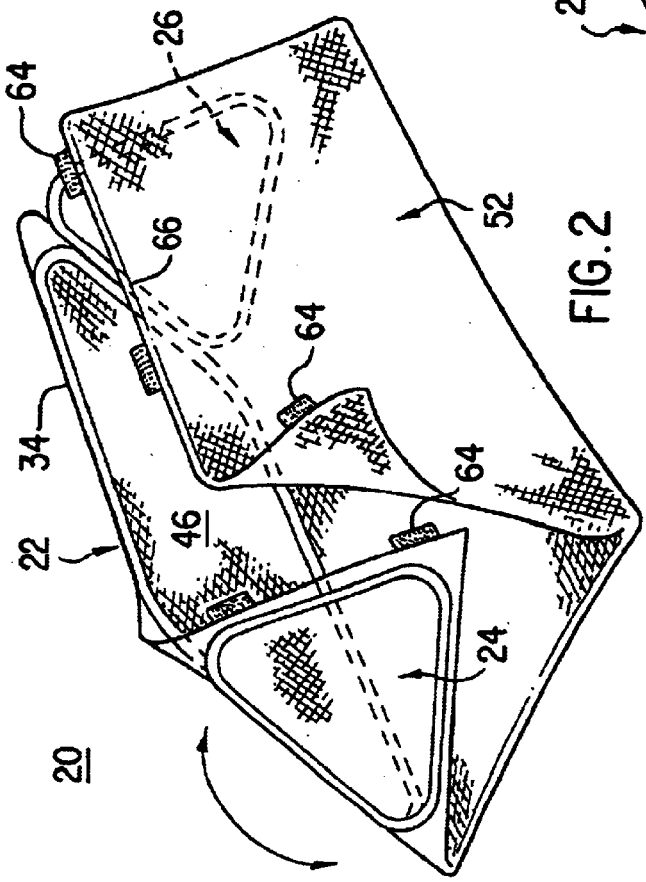
FIG. 2 is a perspective view of the structure of FIG. 1A illustrating a few modifications made thereto.
Figure 10A:
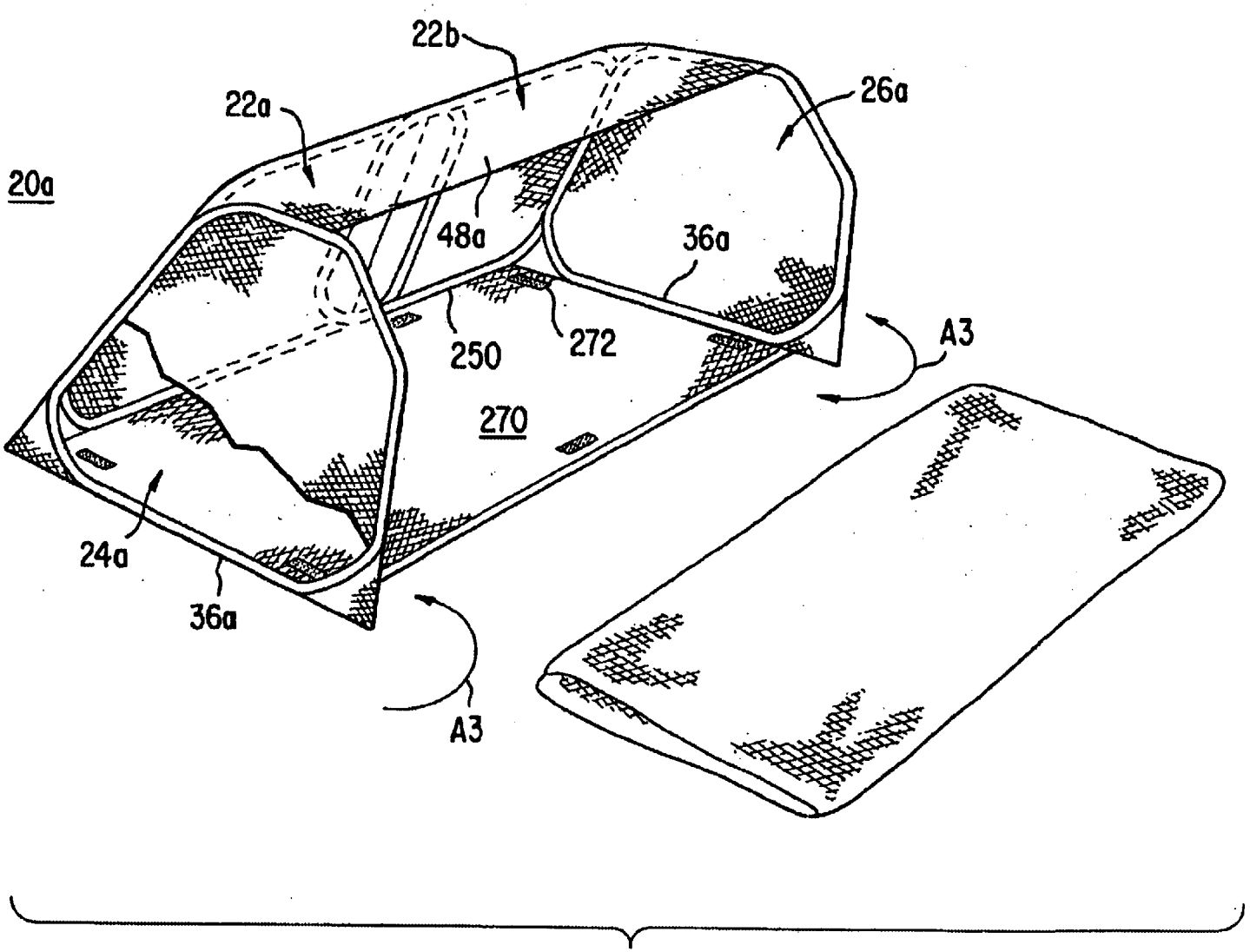
FIGS. 10A–10E illustrate how the structure of FIG. 9 can be twisted and folded to reduce the structure to a size which is a fraction of the size of the free-standing structure.
Figure 11:
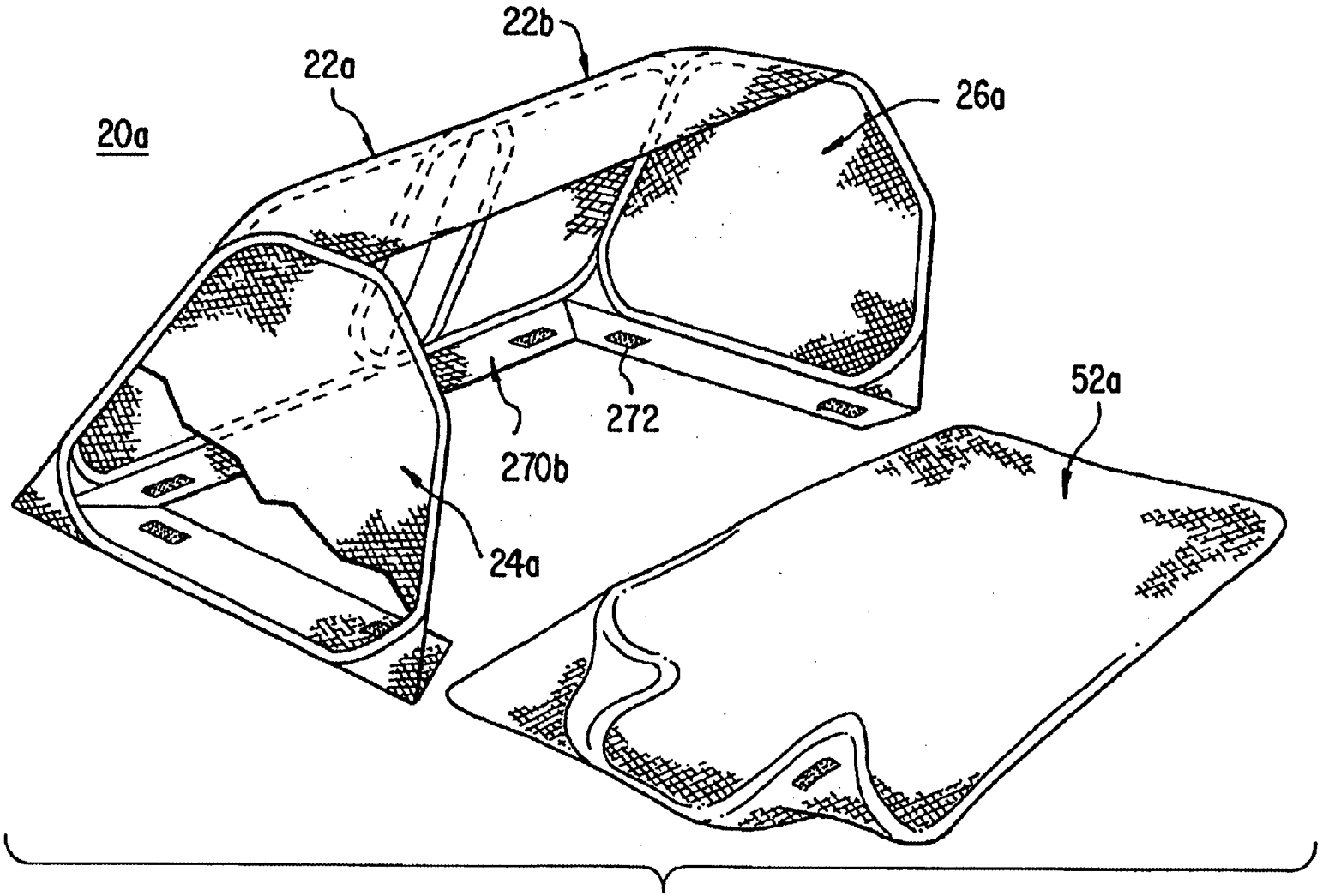
FIG. 11 is a perspective view of the structure of FIG. 10A illustrating modifications made thereto.

A hood 48 can be attached to the sides 34, 40 and 38 of the panels 22, 24 and 26, respectively, to form a canopy or shade. The hood 48 can be made of the same material as the fabric 46, and can be stitched to the sides 34, 40 and 38 of the panels 22, 24 and 26, respectively, in the manner shown in FIG. 1A. The lower edge 50 of the hood 48 can be positioned a distance from the bottom sides 36 of the panels 24 and 26 so as to provide an opening 60 (i.e., below the lower edge 50) for ingress and egress into the interior of the structure 20. A mat 52 can have portions of two sides 54 and 56 permanently attached (e.g., stitched) or removably attached (e.g., such as shown in FIGS. 2, 10A and 11) to the bottom sides 36 of the panels 24 and 26. The mat 52 can be a support that is made of the same structure and material as conventional sleeping bags, and provides a sleeping surface for the occupant of the structure 20. For example, the mat 52 can be filled with a cushioning element that functions to provide a soft and cushioning support surface for the occupant's back and body. The cushioning element can include down, padding, or any other materials used to provide a soft and comfortable support for the user's back and body. The portions of the sides 54 and 56 of the mat 52 that are not attached to the panels 24 and 26 can be used in one of two manners. First, the unattached portions of the mat 52 can be folded up (see Arrow A1) and then removably attached (e.g., via VELCRO™ pads 58) to the hood 48 to close the opening 60, so that the structure 20 can be used as a tent. Second, the unattached portions of the mat 52 can be folded up (see Arrow A1) and then inserted into the interior of the structure 20 to function as a blanket.

Thus, the panels 22, 24, 26 and the hood 48 define the interior of the structure 20. The occupant can easily enter or leave the interior of the structure 20 via the opening 60. The mat 52 functions as both a sleeping surface and as a cover to close the opening 60 when the occupant is sleeping inside the structure 20. The mat 52 can even be used as both a sleeping surface and as a blanket to cover the user. The mat 52 can be conveniently and effectively attached in a removable manner to the hood 48.

FIG. 2 illustrates a modification to the structure 20, where the mat 52 is removably attached (e.g., via the use of VELCRO™ pads 64) to the panels 22, 24 and 26. In addition, the hood 48 can be omitted in the modified structure in FIG. 2 so that the outer edge 66 of the mat 52 can be removably attached (e.g., via the use of VELCRO™ pads 64) to the top side 34 of the panel 22. As a result, the size of the opening 60 is increased, and a portion of the mat 52 would cover the entire opening 60.

The structure 20 shown in FIGS. 1A and 2 can be folded and collapsed very quickly and conveniently. First, as shown in FIG. 3A, the mat 52 can be detached from the panels 22, 24, 26, and the panels 24 and 26 are then folded about their hinged connections against the panel 22. For the structure 20 in FIG. 1A, the hood 48 can be folded in together with the panels 24 and 26 since the hood 48 is made of a flexible and foldable material. The mat 52 can be removed and folded separately (if the mat 52 is removably attached to the panels 22, 24, 26), or can be tucked against the panels 22, 24, 26 and folded together with the panels 22, 24, 26. See FIG. 3B. Then, in the second step shown in FIG. 3C, the resulting structure is then twisted and folded to collapse the frame members and panels into a smaller shape. In particular, the opposite border 68 of the structure 20 is folded in to collapse the frame members with the panels. As shown in FIG. 3D, the fourth step is to continue the collapsing so that the initial size of the structure is reduced. FIG. 3E shows the fifth step with the frame members and panels collapsed on each other to provide for a small essentially compact configuration having a plurality of concentric frame members and layers of the panels so that the collapsed structure has a size which is a fraction of the size of the initial structure.

To deploy the structure 20 for use, the user merely opens the folded panels 22, 24, 26. The natural bias of the frame members 44 will cause the frame members 44 to uncoil, so that the panels 22, 24, 26 quickly spring back to the configuration shown in FIG. 3A. The panels 24 and 26 are folded away from the panel 22, so that the structure 20 is again ready for use. The mat 52 can be re-attached to the panels 22, 24, 26 (if the mat 52 is removably attached to the panels 22, 24, 26) or the mat 52 can be opened from the panels 22, 24, 26 and laid out flat. Thus, the structure 20 can be quickly and easily folded and collapsed for storage, and can be quickly and easily opened and re-deployed for use. The compact size of the collapsed structure 20 makes storage simple and convenient.

Figure 4:
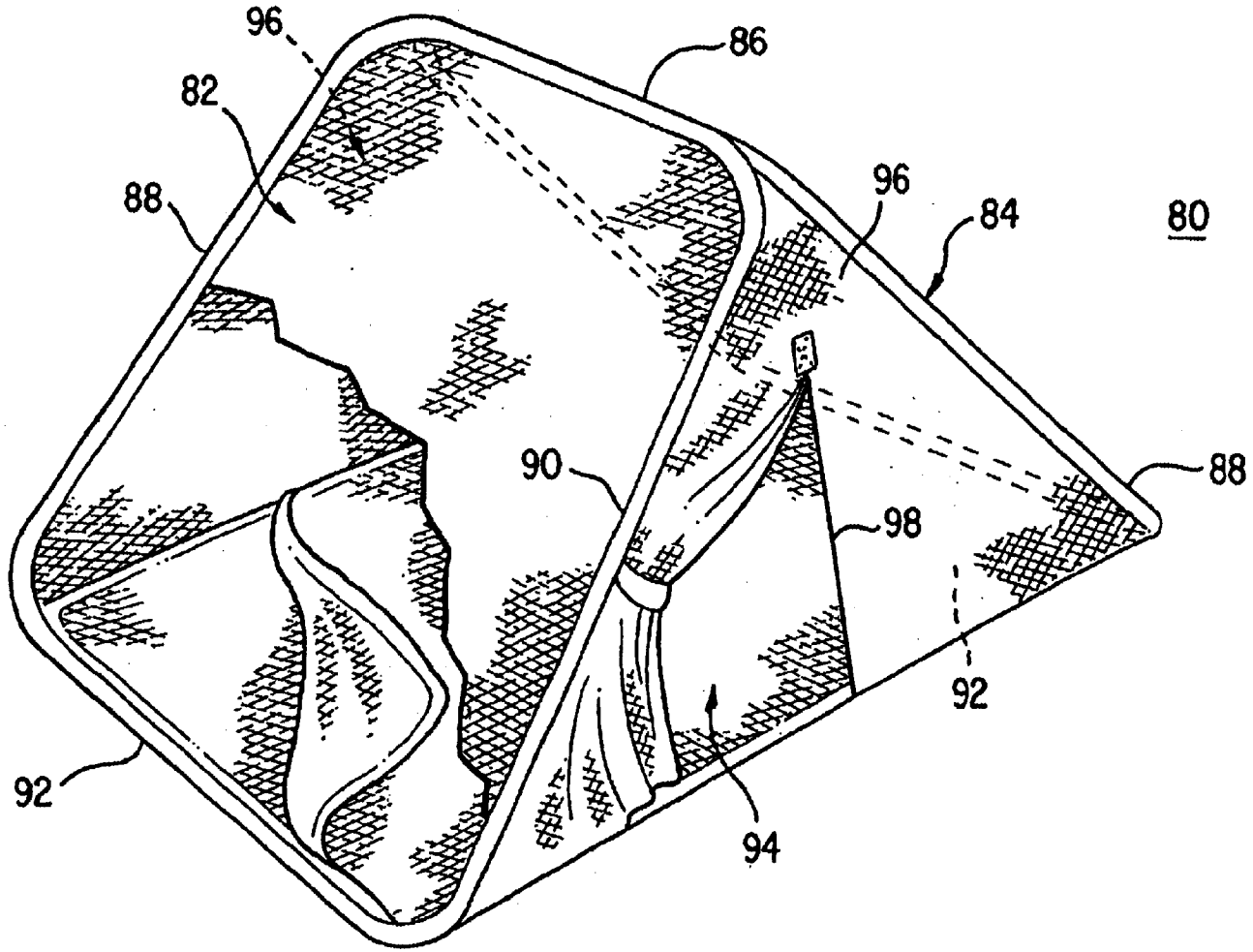

FIG. 4 illustrates another structure 80 having two panels 82 and 84 that are hingedly connected to each other along their top sides 86 thereof to form an inverted V-shape. Each panel 82 and 84 can have the same general construction as the panel 22 illustrated above, and include a frame member that supports and defines the shape of the panel 82 and 84. Although FIG. 4 illustrates each panel 82 and 84 as having four sides, including a top side 86, a left side 88, a right side 90 and a bottom side 92, each panel 82 and 84 can be provided with any number of sides as desired. A mat 94, which can have the same construction and material as the mat 52 described above, can be attached (either by stitching or removably attached via VELCRO™ pads) to the bottom side 92 of each panel 82 and 84. Two opposing side walls 96, which can be made entirely of fabric (as defined above), can be stitched or otherwise attached to the left and right sides 88 and 90 of the panels 82 and 84. A slit 98 can be provided in one or both side walls 96 to allow for ingress and egress into the interior (which is defined by the panels 82, 84 and the side walls 96) of the structure 80. In the structure 80, the mat 94 functions as a base and as a sleeping surface.

The structure 80 can be conveniently folded and collapsed by folding the panels 82 and 84 towards each other about the hinged connection at the top sides 86. The mat 96 can either be removed (if the mat 96 is removably attached) or folded between or outside of the panels 82 and 84. The folding steps illustrated in FIGS. 3C–3E above can then be used to fold and collapse the structure 80 into a smaller configuration for convenient storage. The structure 80 can be quickly and easily re-deployed for use by opening the folded panels 82, 84 so that the natural bias of the frame members will cause the frame members to uncoil, causing the panels 82, 84 to quickly spring open. The panels 82 and 84 can be spread apart to the configuration shown in FIG. 4. The mat 84 can then be re-attached (if previously removed) or merely opened and laid out flat, and the structure 80 is ready for use again.

Figure 5:
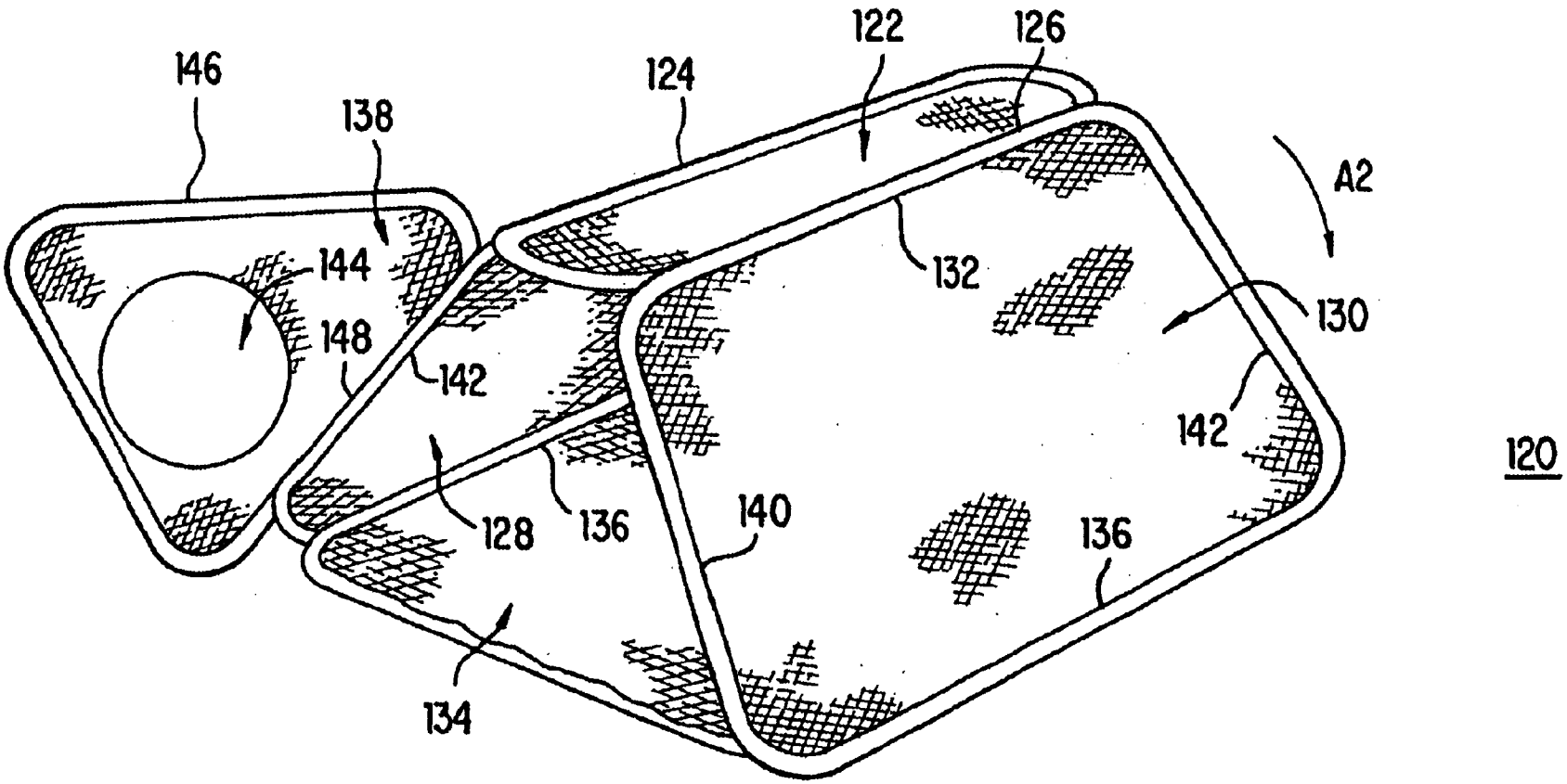

FIG. 5 illustrates another structure 120 that is similar to the structure 80, but contains a few modifications. The structure 120 has a top panel 122 that has two opposing sides 124 and 126, and two side panels 128 and 130 that are hingedly connected along their top sides 132 to the sides 124 and 126, respectively, of the top panel 122. Each panel 122,128 and 130 can have the same general construction as the panel 22 illustrated above, and include a frame member that supports and defines the shape of each panel 122, 128 and 130. Although FIG. 5 illustrates each panel 122,128 and 130 as having four sides, each panel 122, 128 and 130 can be provided with any number of sides as desired. A mat 134, which can have the same construction and material as the mat 52 described above, can be attached (either by stitching or removably attached via VELCRO™ pads) to the bottom side 136 of each side panel 128 and 130. One or two opposing end panels 138, which can have the same general construction as the panel 22 illustrated above, can be hingedly connected to the left side 140 and right side 142 of the panels 128 and 130. If only one end panel 138 is provided, the other end of the structure 120 can be covered by a fabric end wall that is stitched to the sides 140 and 142 of the side panels 128 and 130, respectively. It is preferable to removably attach one side (e.g., 146) of at least one end panel 138 to a side 140 or 142 of one side panel 128, 130 so that the end panel 138 can be swung open like a door to provide easier access to and from the interior of the structure 120. The other side 148 of the end panel 138 can be stitched or removably attached to a side 140 or 142 of the other side panel 128, 130. An opening 144 can also be provided in one or both end panels 138 to allow for ingress and egress into the interior (which is defined by the panels 122, 128, 130, 138) of the structure 120. In the structure 120, the mat 134 functions as a base and as a sleeping surface.

The structure 120 can be conveniently folded and collapsed in the following manner. For example, if the mat 134 is removably attached to one of the panels (e.g., 130), the mat 134 can be detached from the bottom side 136 of the panel 130, and the end panels 138 folded on top of the panel 128 about the hinged connection between the sides 140 or 142 (of panel 128) and the side 148 of the end panel 138. Then, the panels 122 and 130 are folded on top of the panel 128 about the hinged connection between the sides 132 (of panel 128) and 124 in the direction of arrow A2. The panel 130 can then be folded on top of the panels 122 and 128 about the hinged connection between the sides 132 (of panel 130) and 126 in a direction opposite to that of arrow A2 to form a stack of panels 130, 122, 128, 138 (in one possible order). The folding steps illustrated in FIGS. 3C–3E above can then be used to fold and collapse the structure 120 into a smaller configuration for convenient storage.

If the mat 134 is permanently attached to the panels 128, 130, then the end panels 138 are folded into the interior of the structure 120 against the panel 128 (see direction A4) about the hinged connection between the sides 140 or 142 (of panel 128) and the side 148 of the end panel 138. Then, the panels 122 and 130 are folded on top of the panel 128 about the hinged connection between the sides 132 (of panel 128) and 124 in the direction of arrow A2 to form a stack of panels 130+122, 128, 138 (in one possible order). The folding steps illustrated in FIGS. 3C–3E above can then be used to fold and collapse the structure 120 into a smaller configuration for convenient storage.

As an alternative, one or both of the hinged connections along the sides 124 or 126 can be a removable attachment, so that the panels 128 and 130 can be separated from the panel 122. The three panels 122, 128, 130 can be placed on top of each other to form a stack of panels that can be folded and collapsed according to the steps illustrated in FIGS. 3C–3E above.

The structure 120 can be quickly and easily re-deployed for use by opening the folded panels 122, 128, 130, 138 so that the natural bias of the frame members will cause the frame members to uncoil, causing the panels 122,128, 130, 138 to quickly spring open. The panels 122, 128, 130, 138 can then be opened or reassembled to the configuration shown in FIG. 5. The mat 134 can be re-attached to the appropriate panels (e.g., 128 and 130), and the structure 120 is ready for use again.

Figure 6:
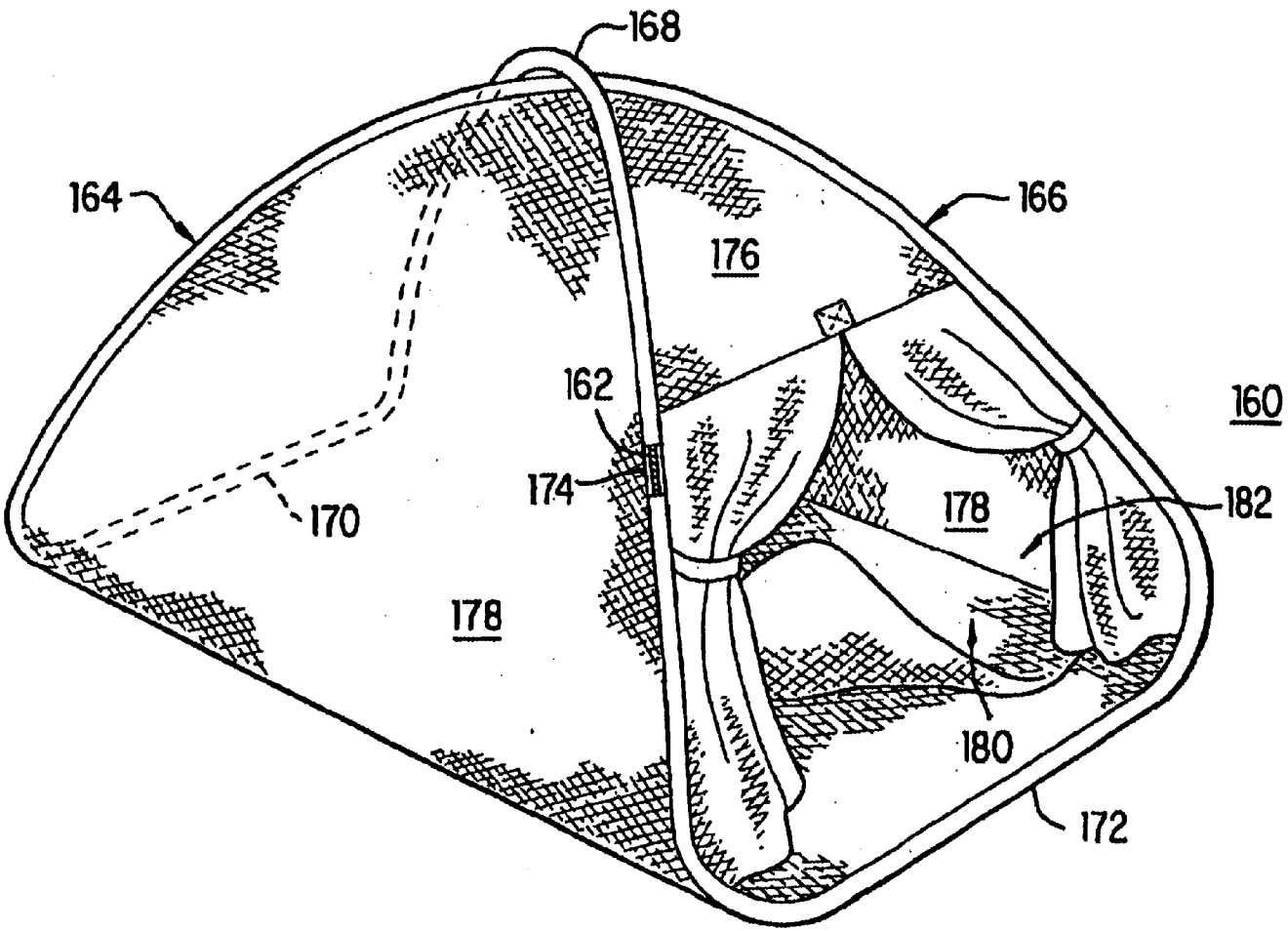

FIG. 6 illustrates a collapsible structure 160 that is made up of a single figure-eight frame member 162. The structure 160 corresponds to the structure shown and described in U.S. Pat. No. 4,825,892, whose entire disclosure is hereby incorporated by this reference as though fully set forth herein. The figure-eight configuration of the frame member 162 is characterized by a left loop 164 separated from a right loop 166 by a crossover point 168. The loops 164 and 166 have straight portions 170 and 172, respectively, for resting on a flat surface when the structure 160 is in the configuration shown in FIG. 6. The frame member 162 can be formed from any of the materials used for the frame members 44 above. The figure-eight configuration shown in FIG. 6 can be formed by a single 360 degree twist of the frame member 162.

The structure 160 has left and right frame retaining sleeves 174 which retain the frame member 162. The sleeves 174 also define straight portions to retain the straight portions 170 and 172. Fabric 176 can be stitched or otherwise attached to the sleeves 174 to form opposing fabric side walls that are defined by the loops 164, 166. In addition, fabric 178 can also be stitched to the sleeves 174 to form side walls that join opposing spaces between the loops 164, 166. As a result, the fabric pieces 176 and 178 would define the interior of the structure 160. A mat 180, which can have the same construction and material as the mat 52 described above, can be attached (either by stitching or removably attached via VELCRO™ pads) to the straight portions 170 and 172. An opening 182 can also be provided in one or both fabric pieces 176, 178 to allow for ingress and egress into the interior of the structure 160. In the structure 160, the mat 180 functions as a base and as a sleeping surface.

The structure 160 can be folded and collapsed by reference to FIGS. 5–7 of U.S. Pat. No. 4,825,892. In summary, the straight portions 170, 172 are pushed towards each other, and the two loops 164, 166 are deformed so that they overlie each other and crossover 168 is partly bent towards one of the straight portions (e.g., 170). The crossover 168 is then further bent towards the straight portion 170, and then the steps in FIGS. 3C–3E hereinabove can be applied to complete the twisting and folding.

Figure 7A:
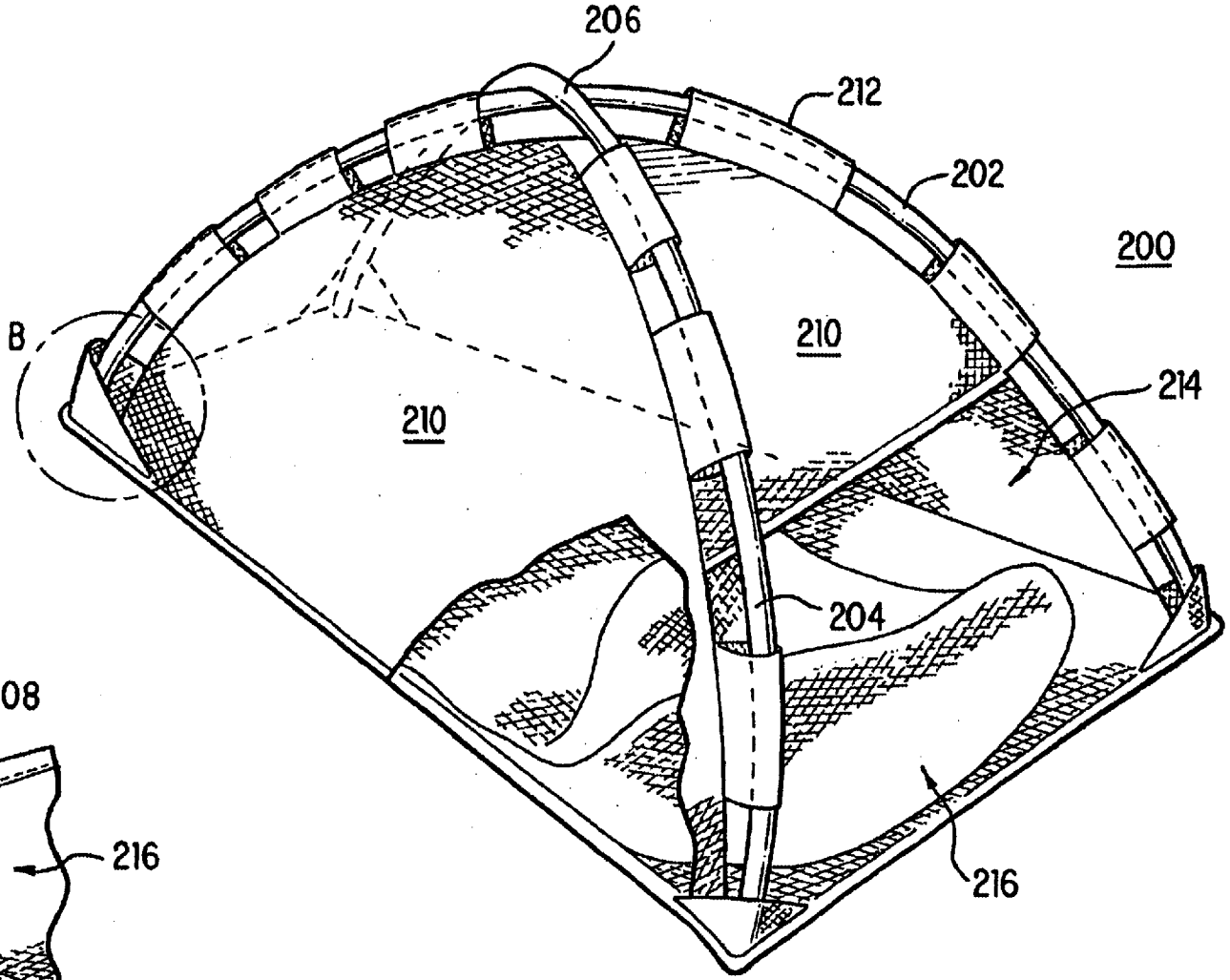
Figure 7B:
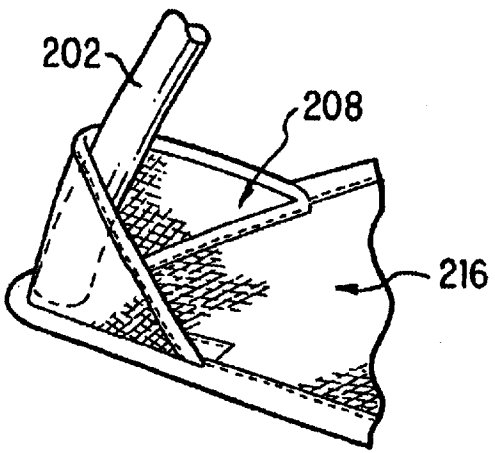
FIG. 7B is an expanded view of the section B of the structure of FIG. 7A.

FIGS. 7A and 7B illustrate a structure 200 which has two separate crossing frame members 202, 204 that can be of the same material as the frame member 44 illustrated above. The frame members 202, 204 cross at an apex 206, and their respective ends are secured to holding mechanisms 208 provided at the corners of a mat 216, so as to form a domed or apexed configuration for the structure 200. Each holding mechanism 208 can take the form of an angled piece of fabric which retains the end of a frame member 202, 204 inside its interior. The mat 216 can have the same construction and material as the mat 52 described above. Fabric material 210 can be stitched or otherwise attached to the frame members 202, 204 to define the interior of an enclosing tent. Frame retaining sleeves 212 can be stitched to the fabric 210 to retain the frame members 202, 204. An opening 214 can also be provided at one or more locations in the fabric material 210 to allow for ingress and egress into the interior of the structure 200. In the structure 200, the mat 216 functions as a base and as a sleeping surface.

Figure 8:
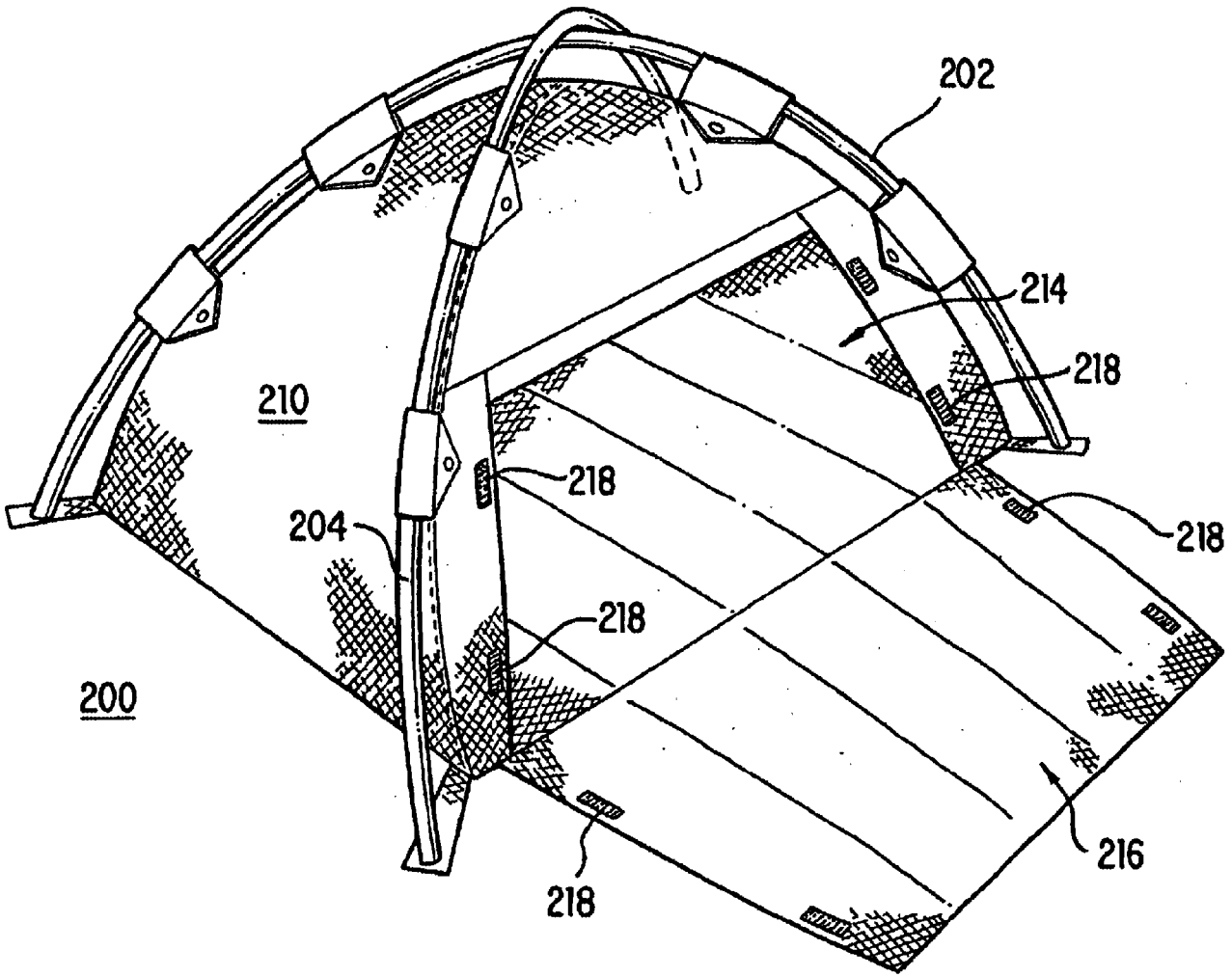
FIG. 8 is a perspective view of the structure of FIG. 7A illustrating a few modifications made thereto.

FIG. 8 illustrates the same structure 200 from FIG. 8, except that the mat 216 is also used to cover the opening 214 using the same principles illustrated above in connection with FIGS. 1A and 2. In this regard, removable attachment mechanisms (such as VELCRO™ pads 218) can be used to removably attach portions of the mat 216 to the fabric material 210. As an alternative, the covering (outer) portion of the mat 216 can be inserted through the opening 214 into the structure 200 for use as a blanket.

Figure 9:
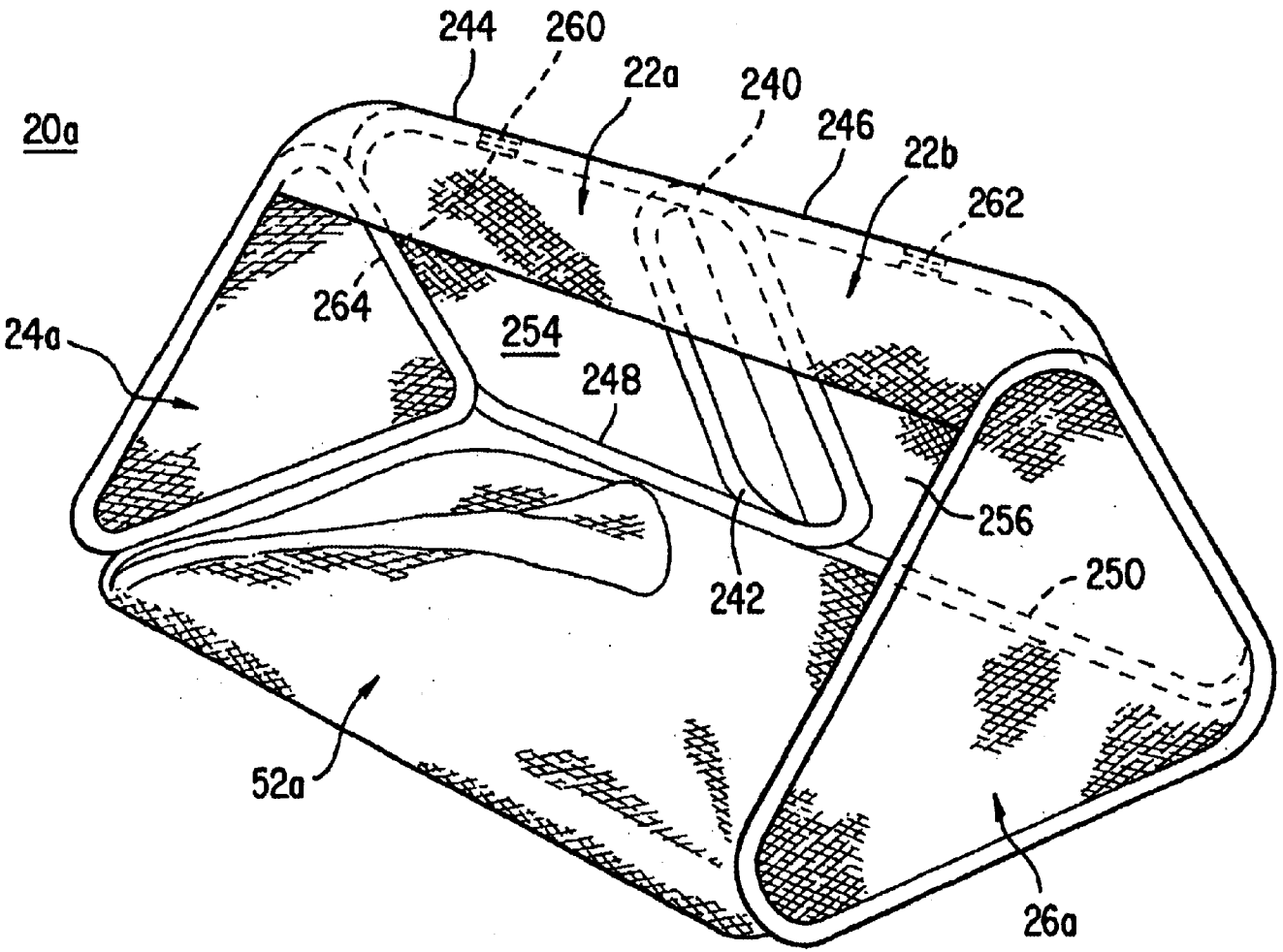
FIG. 9 is a perspective view of a collapsible structure according to another embodiment of the present invention.

FIG. 9 illustrates a structure 20*a* that has the same general configuration as the structure 20 in FIG. 1, except that the panel 22 in structure 20 is now replaced by two overlapping panels 22*a* and 22*b*. Otherwise, the other elements in structure 20*a* are the same as the corresponding elements in structure 20. Therefore, the same numeral designations will be used in FIGS. 1A and 9, except than an "a" has been added to the designations in FIG. 9, and no further description of these elements will be repeated for structure 20*a* in FIG. 9.

The construction of the overlapping panels 22*b* and 22*b* is illustrated in greater detail in FIGS. 1A and 3 of U.S. Pat. No. 5,975,101, whose entire disclosure is hereby incorporated by this reference as though fully set forth herein. In particular, each panel 22*a* and 22*b* is defined by a separate resilient frame member, so that the two separate frame members 260 and 262 together define the outer boundary of the overlapping panels 22*a*, 22*b*, respectively. Each frame member 260, 262 can be the same as the frame member 44 in FIG. 1B hereinabove, and are fitted within each other, and overlap or cross-over each other at overlapping points 240 and 242. The overlapping point 240 is defined by the intersection or crossing of the upper sides 244 and 246 of frame members 260 and 262, respectively, and the overlapping point 242 is defined by the intersection or crossing of the lower sides 248 and 250 of frame members 260 and 262, respectively. The overlapping points 240 and 242 can be positioned anywhere along the upper sides 244, 246 or lower sides 248, 250. The two overlapping frame members 260, 262 are pivotable about their overlapping points 240 and 242 between two positions, a first completely open position in which both frame members 260, 262 lie flat in about the same plane (as shown in FIG. 9), and a second folded position in which the frame members 260, 262 are folded towards each other (such as in the direction of arrow A3 in FIG. 10C) to overlie each other. Each frame member 260, 262 is retained in a loop retaining portion (e.g., see 264) of one or more fabric pieces. For example, as shown in FIG. 9, two fabric pieces 254 and 256 are provided, one for each frame member 260 and 262, respectively. Each fabric piece 254 and 256 covers (either partially or completely) and forms a panel 22*a* or 22*b* within the respective frame member 260 or 262, and is preferably held in tension with the frame member 260 or 262. The fabric pieces 254, 256 can also cross each other along an imaginary line defined by the two overlapping points 240 and 242. The other details relating to the overlapping panels 22*a* and 22*b* are set forth in greater detail in the specification and drawings of U.S. Pat. No. 5,975,101, and shall not be repeated herein.

As illustrated in FIG. 10A, the structure 20*a* can be provided with a separate fabric base 270 that has its edges stitched to the bottom sides 36*a*, 248 and 250 of the panels 22*a*, 22*b*, 24*a* and 26*a*. The mat 52*a* can then be placed on top of and removably secured (e.g., by VELCRO™ pads 272) to the fabric base 270.

As a further alternative, FIG. 11 shows that the fabric base 270*b* can be provided in the form of a narrow strip of material that traverses the bottom sides 36*a*, 248, 250 of the panels 22*a*, 22*b*, 24*a* and 26*a*, with VELCRO™ pads 272 provided along the fabric base 270*b*. Otherwise, the structures shown in FIGS. 10A and 11 are identical.

Figure 10B:
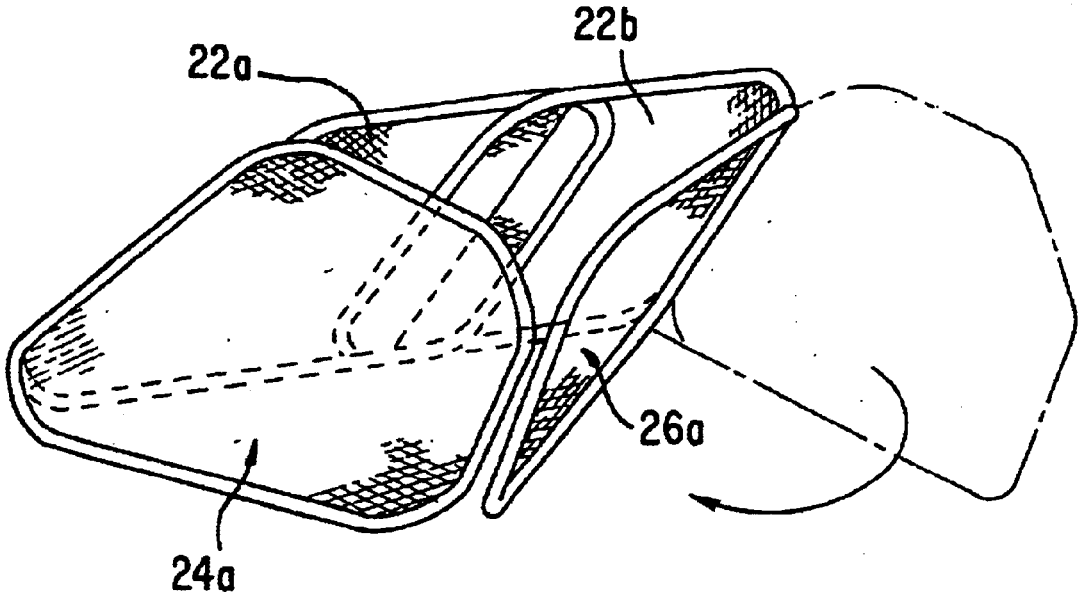
Figure 10C:
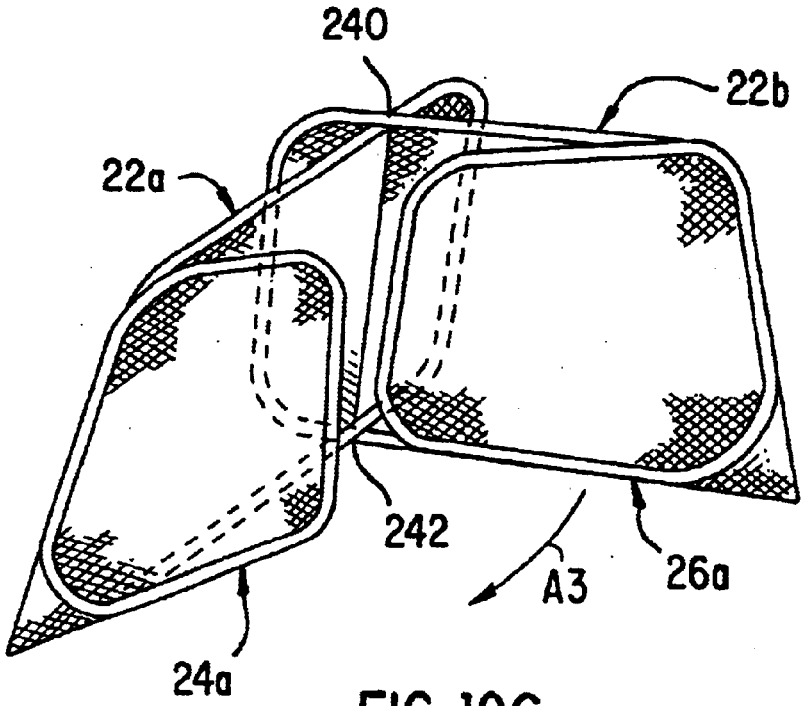
Figure 10D:
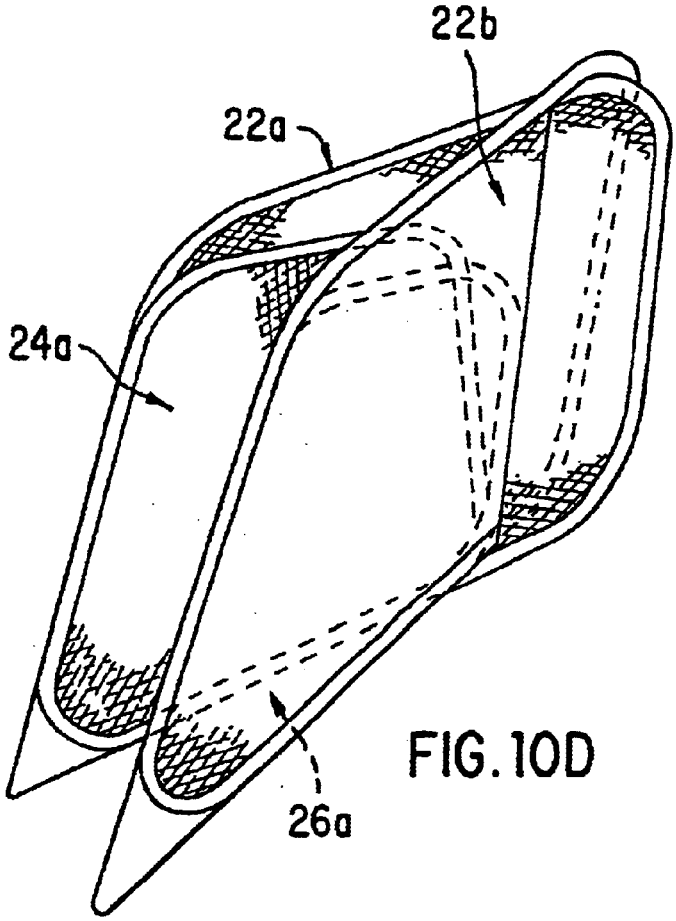
Figure 10E:
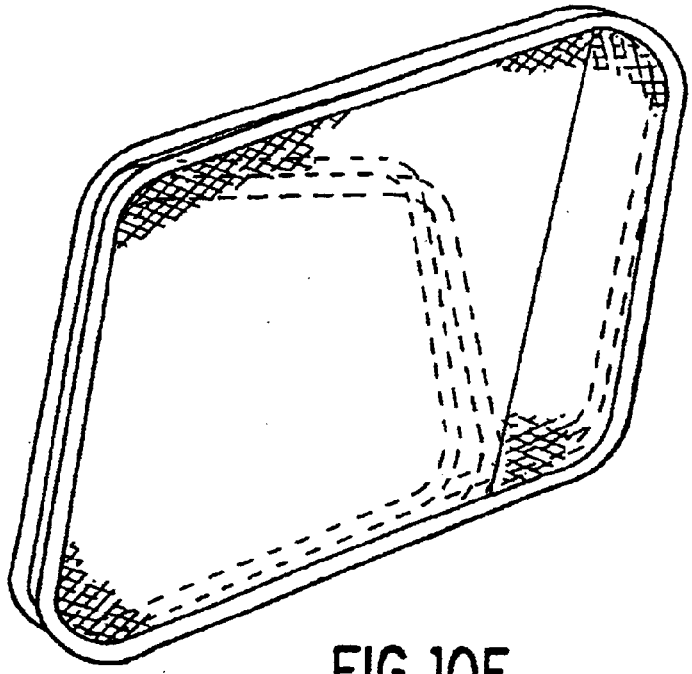

FIGS. 10A–10D also illustrate how the structure 20*a* can be twisted and folded to reduce its configuration. In FIGS. 10A and 10B, the mat 52*a* can be detached from the panels 22*a*, 22*b*, 24*a*, 26*a*, and the panels 24*a* and 26*a* are then folded about their hinged connections with the panels 22*a* and 22*b*, respectively, to be placed on top of the panels 22*a* and 22*b*, respectively. Then, as shown in FIG. 10C, the panels 22*a*, 22*b* are folded about the hinge defined by their overlapping points 240 and 242 to form one stack of panels 22*a*, 24*a*, 26*a*, 22*b* (in one possible order), as shown in FIGS. 10D and 10E. The folding steps illustrated in FIGS. 3C–3E above can then be used to fold and collapse the stack of panels into a smaller configuration for convenient storage. If the mat 52*a* is not removably attached to the panels 22*a*, 22*b*, 24*a*, 26*a*, the mat 52*a* can be folded against the stack of panels shown in FIG. 10E, and folded along with the panels.

To re-deploy the structure 20*a* for use, the user merely opens the folded panels 22*a*, 22*b*, 24*a*, 26*a*. The natural bias of the frame members 44 will cause the frame members 44 to uncoil, so that the panels 22*a*, 22*b*, 24*a*, 26*a* quickly spring back to the configuration shown in either FIG. 10C or 10D. The panels 24*a* and 26*a* are folded away from the panels 22*a*, 22*b*, and the mat 52*a* re-attached to the panels 22*a*, 22*b*, 24*a*, 26*a*, or opened out and laid flat, so that the structure 20*a* is again ready for use.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A collapsible structure, comprising:

a first panel, a second panel and a third panel, each panel having a foldable frame member that has a folded and an unfolded orientation, with a fabric material covering portions of each respective frame member to form the panel for each frame member when the frame member is in the unfolded orientation, each panel having a left side, a right side and a bottom side;

wherein the left side of the first panel is hingedly coupled to the right side of the second panel, and the right side of the first panel is hingedly coupled to the left side of the third panel;

wherein the left side of the second panel and the right side of the third panel are free of any connections to any panels; and a mat coupled adjacent the bottom side of at least one of the panels;

wherein the mat extends beyond the bottom side of the at least one of the panels.

2. The structure of claim 1, further including a hood coupled to the panels.

3. The structure of claim 1, further including a base coupled to the panels, with the mat attached to the base.

4. The structure of claim 3, wherein the mat is removably attached to the base.

5. The structure of claim 3, wherein the base comprises a narrow strip of material that traverses the bottom sides of the panels.

6. The structure of claim 1, further including means for attaching the mat to at least one of the panels.

7. The structure of claim 1, wherein each frame member is twisted and folded to its folded orientation reduce the overall size of the frame member.

8. The structure of claim 1, wherein each panel further includes a frame retaining sleeve for retaining the respective frame member.

9. The structure of claim 1, wherein the mat includes means for cushioning the body of an occupant.

10. A collapsible structure, comprising;

a first panel, a second panel and a third panel, each panel having a foldable frame member that has a folded and an unfolded orientation, with a fabric material covering portions of each respective frame member to form the panel for each frame member when the frame member is in the unfolded orientation, each panel having a left side, a right side and a bottom side;

wherein the left side of the first panel is hingedly coupled to the right side of the second panel, and the right side of the first panel is hingedly coupled to the left side of the third panel;

wherein the left side of the second panel and the right side of the third panel are free of any connections to any panels; and a mat coupled adjacent the bottom side of at least one of the panels;

wherein the mat is folded up to be removably coupled to either the left side of the second panel or the right side of the third panel.

11. The structure of claim 10, wherein the mat extends beyond the bottom side of the at least one of the panels.

12. The structure of claim 10, further including a hood coupled to the panels.

13. The structure of claim 10, further including a base coupled to the panels, with the mat attached to the base.

14. The structure of claim 13, wherein the mat is removably attached to the base.

15. The structure of claim 13, wherein the base comprises a narrow strip of material that traverses the bottom sides of the panels.

16. The structure of claim 10, wherein each frame member is twisted and folded to its folded orientation reduce the overall size of the frame member.

17. The structure of claim 10, wherein each panel further includes a frame retaining sleeve for retaining the respective frame member.

18. The structure of claim 10, wherein the mat includes means for cushioning the body of an occupant.

* * * * *